US007316222B2

(12) United States Patent
Danjyo

(10) Patent No.: US 7,316,222 B2
(45) Date of Patent: Jan. 8, 2008

(54) FUEL FEED APPARATUS HAVING FUEL PUMP

(75) Inventor: Hajime Danjyo, Kariya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/714,118

(22) Filed: Mar. 6, 2007

(65) Prior Publication Data

US 2007/0209641 A1 Sep. 13, 2007

(30) Foreign Application Priority Data

Mar. 10, 2006 (JP) ..... 2006-065474

(51) Int. Cl.
*F02M 37/04* (2006.01)
*F02M 37/08* (2006.01)

(52) U.S. Cl. ..... 123/509; 137/565.22

(58) Field of Classification Search ..... 123/509, 123/510, 514; 137/565.22, 574, 147; 417/198
See application file for complete search history.

(56) References Cited

U.S. PATENT DOCUMENTS 5,082,426 A * 1/1992 Sasaki et al. ..... 417/198
6,513,503 B2 * 2/2003 Iwamoto et al. ..... 123/509
6,832,602 B2 * 12/2004 Tanimura ..... 123/509
7,066,153 B2 * 6/2006 Vitalis et al. ..... 123/514

FOREIGN PATENT DOCUMENTS

JP 2004-197718 7/2004

* cited by examiner

*Primary Examiner*—Mahmoud Gimie
(74) *Attorney, Agent, or Firm*—Nixon & Vanderhye P.C.

(57) ABSTRACT

A fuel feed apparatus includes a fuel pump for pumping fuel from a fuel tank to an internal combustion engine. A pressure-control valve controls pressure of fuel, which is discharged from the fuel pump, to be equal to or less than a first pressure. A jet pump generates suction pressure by jetting fuel, which is discharged from the fuel pump, partially through a nozzle. A pressure-retention valve is provided in an upstream of the jet pump with respect to fuel flow from the fuel pump for maintaining pressure of fuel in the upstream at a second pressure, which is less than the first pressure. A pump bracket holds the fuel pump. The pressure-control valve and the pressure-retention valve are connected to the pump bracket.

11 Claims, 9 Drawing Sheets

FUEL FEED APPARATUS HAVING FUEL PUMP

CROSS REFERENCE TO RELATED APPLICATIONS

This application is based on and incorporates herein by reference Japanese Patent Applications No. 2006-65474 filed on Mar. 10, 2006.

FIELD OF THE INVENTION

The present invention relates to a fuel feed apparatus having a fuel pump.

BACKGROUND OF THE INVENTION

Conventionally, a fuel feed pump includes a fuel pump for supplying fuel from a fuel tank into an internal combustion engine. According to JP-A-2004-197718, a fuel feed apparatus includes a jet pump for generating suction pressure by jetting fuel, which is discharged from a fuel pump, partially from a nozzle. The fuel feed pump includes a fuel passage through which the fuel pump discharges fuel. A residual-pressure-retention valve is provided to the fuel passage in an upstream of the jet pump. When the fuel pump stops, the pressure-retention valve retains fuel in the fuel passage by blocking from the jet pump, so as to maintain pressure in the fuel passage at predetermined pressure. In this structure, fuel at the predetermined pressure can be quickly supplied when the internal combustion engine requests fuel supply in a case where the fuel pump stops.

Another generally-known fuel feed apparatus includes a pressure-control valve for controlling pressure of fuel, which is discharged from a fuel pump, to be less than predetermined pressure.

In each of conventional fuel feed apparatuses, one of the pressure-retention valve and the pressure-control valve is provided to a pump bracket such as a filter case, and the other of the pressure-retention valve and the pressure-control valve is provided to a pipe, which communicates an outlet of a filter case with the internal combustion engine. In these structures, the location of the valve in the pipe is limited to specific positions within the vehicle. Accordingly, arrangement of the valve is subjected with constraints in the installation of the fuel feed apparatus in the vehicle.

A fuel feed apparatus may not include the pressure-retention valve or the pressure-control valve in dependence upon types of vehicles. Conventionally, a fuel feed apparatus is modified for combination of the pressure-retention valve and/or the pressure-control valve, in accordance with existence or nonexistence of the pressure-retention valve and/or the pressure-control valve. Accordingly, commonality of the mounting structure of the fuel feed apparatus cannot be achieved in different kinds of vehicles.

SUMMARY OF THE INVENTION

The present invention addresses the above disadvantage. According to one aspect of the present invention, a fuel feed apparatus is provided for an internal combustion engine having a fuel tank. The fuel feed apparatus includes a fuel pump for pumping fuel from the fuel tank to the internal combustion engine. The fuel feed apparatus further includes a pressure-control valve for controlling pressure of fuel, which is discharged from the fuel pump, to be equal to or less than a first pressure. The fuel feed apparatus further includes a jet pump for generating suction pressure by jetting fuel, which is discharged from the fuel pump, partially through a nozzle. The fuel feed apparatus further includes a pressure-retention valve that is provided in an upstream of the jet pump with respect to fuel flow from the fuel pump for maintaining pressure of fuel in the upstream at a second pressure, which is less than the first pressure. The fuel feed apparatus further includes a pump bracket for holding the fuel pump. The pressure-control valve and the pressure-retention valve are connected to the pump bracket.

According to another aspect of the present invention, a fuel feed apparatus is provided for an internal combustion engine having a fuel tank. The fuel feed apparatus includes a fuel pump for pumping fuel from the fuel tank to the internal combustion engine. The fuel feed apparatus further includes a pump bracket for holding the fuel pump. The pump bracket defines a fuel passage through which the fuel pump discharges fuel. The pump bracket has a pressure-control valve holder and a pressure-retention valve holder. The pressure-control valve holder is connectable with a pressure-control valve, which is for controlling pressure of fuel, which is discharged from the fuel pump, to be equal to or less than a first pressure. The pressure-control valve holder defines a first space communicating with the fuel passage. The pressure-retention valve holder is connectable with a pressure-retention valve, which is for maintaining pressure of fuel at a second pressure, which is less than the first pressure. The pressure-retention valve holder defines a second space communicating with the fuel passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
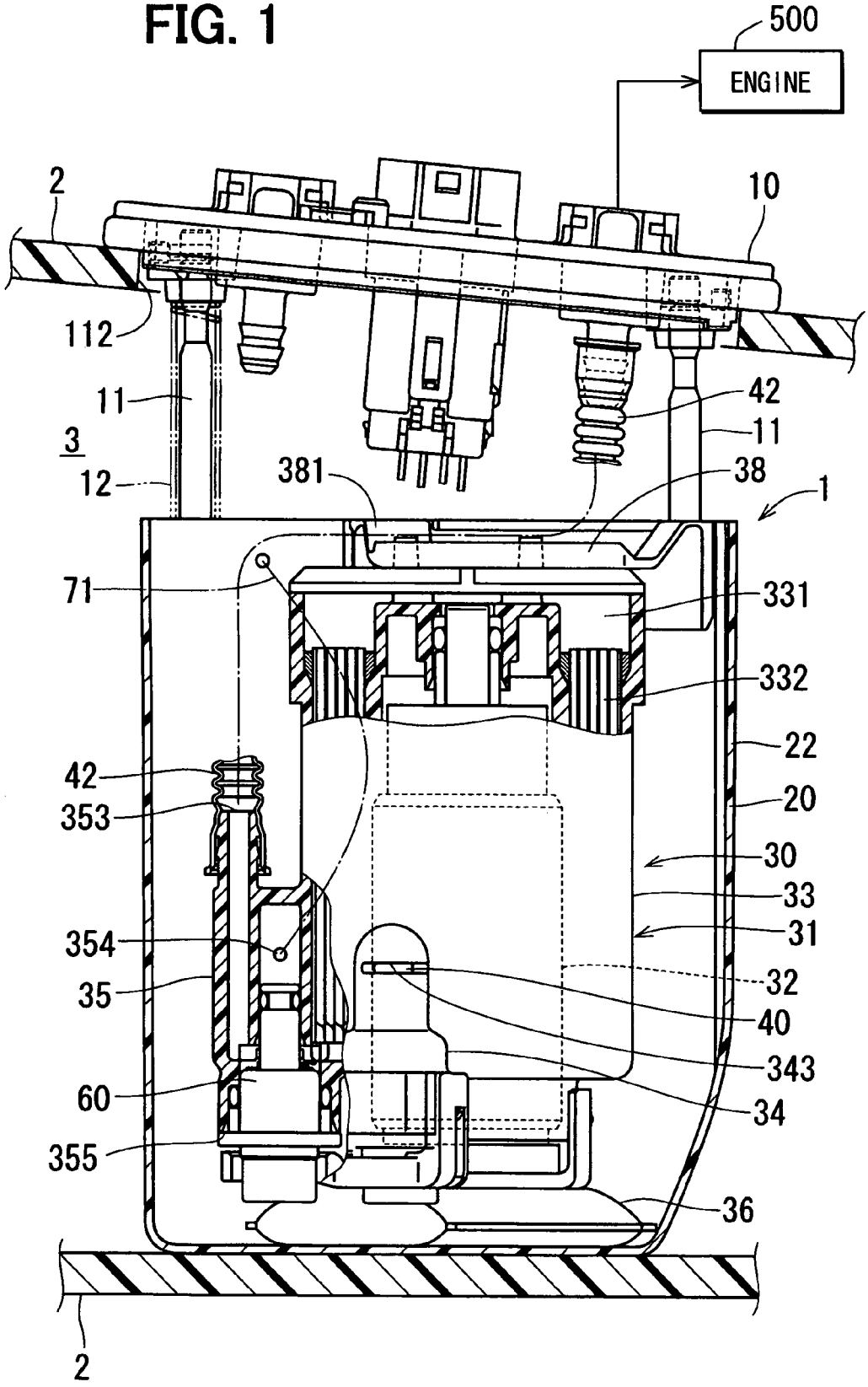
FIG. 1 is a sectional longitudinal view showing a fuel feed apparatus according to a first embodiment.

As shown in FIGS. 1 to 4, a fuel feed apparatus 1 supplies fuel from a fuel tank 2 to an external device such as an internal combustion engine 500. The fuel feed apparatus 1 includes a flange 10, a sub-tank 20, a pump module 30, and a jet pump 70.

Figure 9:
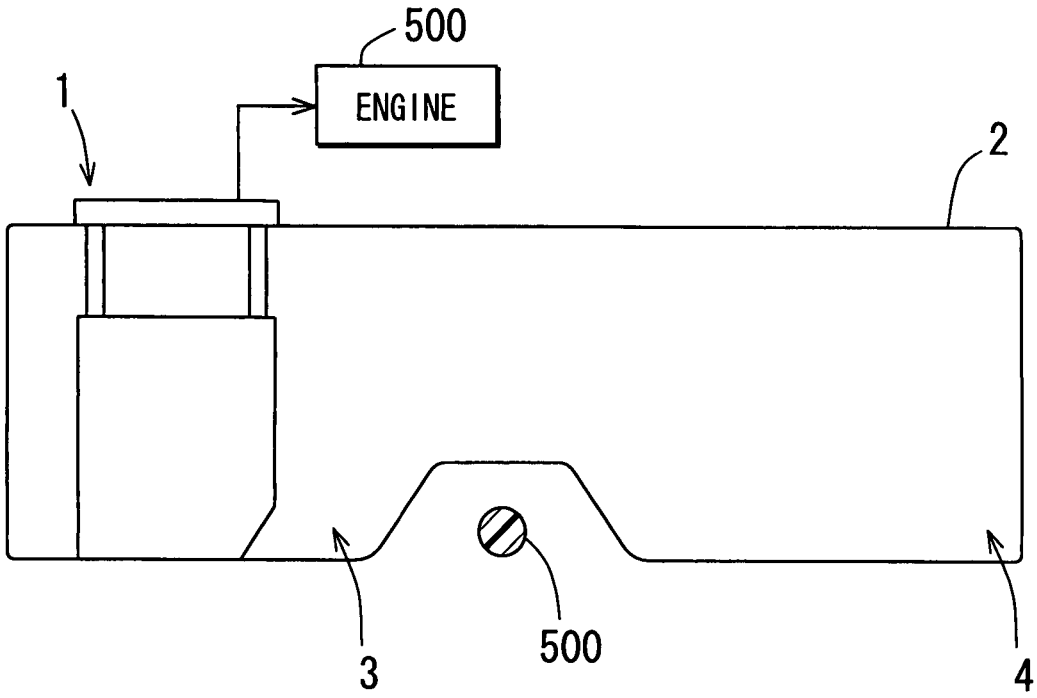
FIG. 9 is a schematic view showing a fuel tank accommodating the fuel feed apparatus.

As referred to FIG. 1, a flange 10 of the fuel feed apparatus 1 is in a substantially disc-shape to serve as a lid member. The flange 10 is provided to an upper wall of the fuel tank 2 so as to cover an opening 112 of the fuel tank 2. As shown in FIG. 9, the fuel tank 2 is a substantially saddle-shaped. The fuel tank 2 is installed on, for example, a driveshaft 550 of the engine 500. The fuel tank 2 includes a first tank chamber 3 and a second tank chamber 4. The first tank chamber 3 accommodates the sub-tank 20. The second tank chamber 4 does not accommodate the sub-tank 20.

As referred to FIG. 1, the flange 10 is provided with an outlet pipe and an electric connector (nor shown). Components of the fuel feed apparatus 1 other than the lid member 10 are accommodated in the fuel tank 2.

The sub-tank 20 is in a substantially bottomed cylindrical shape. As referred to FIG. 2, the sub-tank 20 has a sidewall 22 having a circumferential periphery, which is partially dented radially inwardly to define a step portion 28. The sub-tank 20 is in a substantially cylindrical shape other than the step portion 28. The step portion 28 is substantially flat. The step portion 28 is provided with a sender gauge 44, which is connected with a float 46.

Each of shafts 11 is press-inserted into the flange 10 at one end, and is loosely inserted into an inserted portion 23 of the sub-tank 20 at the other end. A spring 12 biases the flange 10 and the sub-tank 20 to separate from each other. Thus, the flange 10 and the sub-tank 20, which accommodates the pump module 30, are movable relatively to each other substantially in the vertical direction of the fuel tank 2, i.e. in a vertical direction in FIG. 1. Therefore, even when the fuel tank 2 accommodating the fuel feed apparatus 1 expands or shrinks due to change in temperature, inner pressure, and/or an amount of fuel, the bottom of the sub-tank 20 can be regularly pressed onto the inner bottom periphery of the fuel tank 2.

Figure 2:
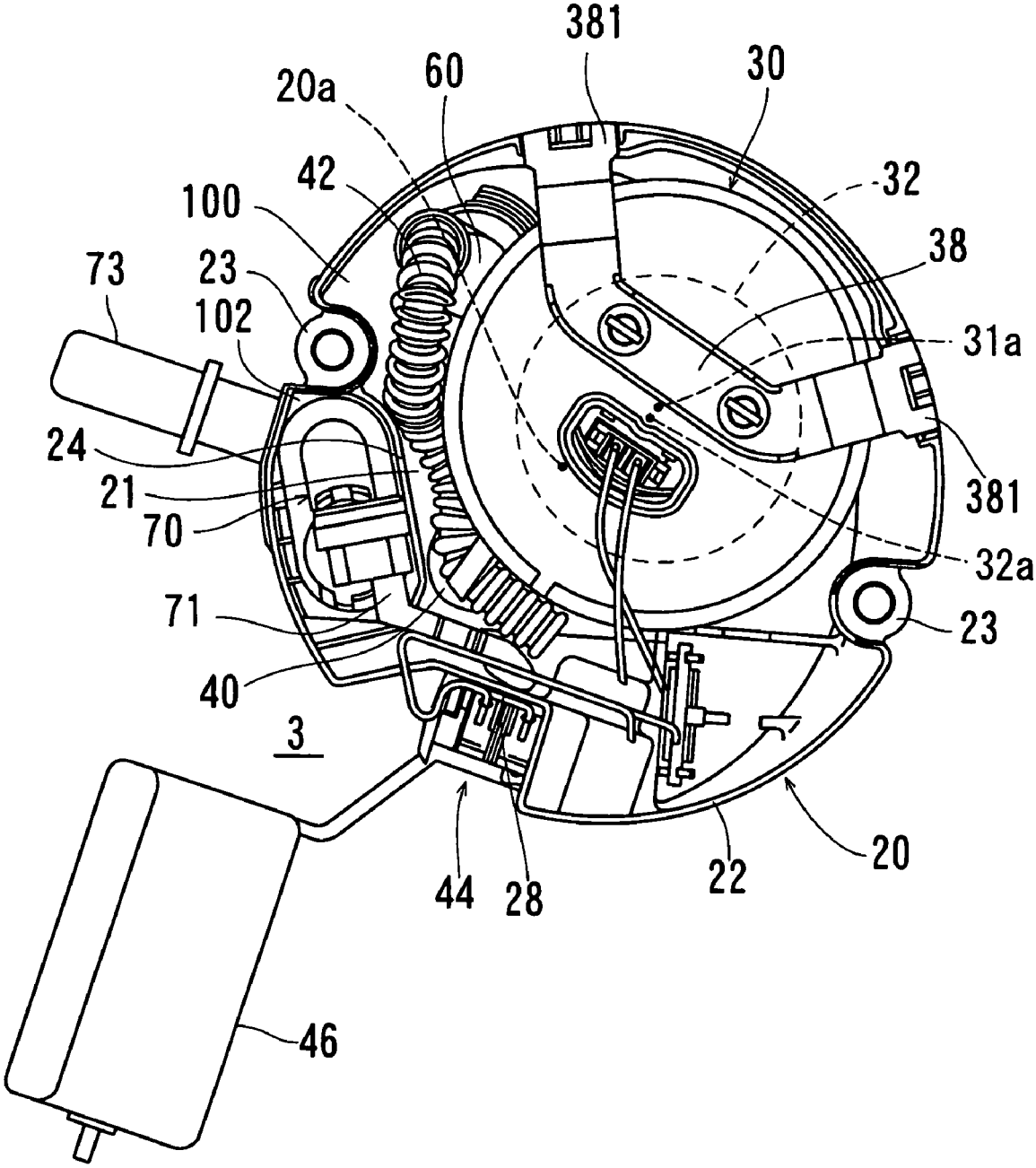
FIG. 2 is a front view showing the fuel feed apparatus.

As referred to FIGS. 1, 2, a partition wall 24 partitions the inner space of the sub-tank 20 into a main chamber 100 and an auxiliary chamber 102. The main chamber 100 accommodates the pump module 30. The pump module 30 includes a fuel pump 32, a fuel filter 332, a suction filter 36, a pressure-control valve 40, and a residual-pressure-retention valve 60. The fuel pump 32 accommodates an unillustrated motor. The pump module 30 further accommodates an unillustrated rotor member such as an impeller that rotates together with the motor for generating suction pressure. The pump module 30 pumps fuel from the sub-tank 20 through the suction filter 36.

The pressure-control valve 40 controls pressure of fuel, which is discharged from the fuel pump 32 and removed of foreign matters through the fuel filter 332, to be less than predetermined pressure such as 400 kPa. The pressure-controlled fuel is discharged through the flange 10 into the engine 500, which is outside the fuel tank 2, after flowing through a bellows pipe 42. The bellows pipe 42 serves as an engine pipe. The pressure-retention valve 60 is provided for restricting fuel from leaking from the bellows pipe 42 through the jet pump 70 when the fuel pump 32 stops. The pressure-retention valve 60 maintains pressure in the bellows pipe 42 to be equal to or greater than predetermined second pressure P2 such as 324 kPa. The second pressure P2 is set to be less than the first pressure P1. Arrangement of the pressure-control valve 40 and the pressure-retention valve 60 will be described later.

The jet pump 70 includes a nozzle 72, an inlet pipe 73, and an outlet pipe 74 for transferring fuel. The jet pump 70 jets fuel, which is discharged from the fuel pump 32, partially through the nozzle 72, so that the jet pump 70 generates suction pressure. This suction pressure attracts fuel from the second chamber 4 of the fuel tank 2 into the auxiliary chamber 102 of the sub-tank 20 through the inlet pipe 73 and the outlet pipe 74. In this structure, the sub-tank 20 can be charged with fuel, even when fuel in the first tank chamber 3 (FIG. 9) of the fuel tank 2 decreases.

The jet pump 70 is accommodated in the auxiliary chamber 102, so that the nozzle 72 can be filled with fuel. Therefore, liquid seal can be readily formed around the nozzle 72, so that fuel in the second tank chamber 4 can be quickly supplied into the sub-tank 20 when the engine 500 is started. Furthermore, the jet pump 70 is arranged vertically along the depth direction of the auxiliary chamber 102. Therefore, the sub-tank 20 can be downsized compared with a structure, in which the jut pump 70 is horizontally arranged. The inlet pipe 73 (FIG. 3) is fitted to the inner wall of the sub-tank 20, and is connected into the auxiliary chamber 102. The outlet pipe 74 opens toward the bottom of the auxiliary chamber 102.

In this fist embodiment, the sub-tank 20 has the bottom sidewall defining an unillustrated communication hole for communicating the first tank chamber 3 of the fuel tank 2 with the sub-tank 20. A jet pump is not provided for pumping fuel from the first tank chamber 3 of the fuel tank 2 into the sub-tank 20. Alternatively, the communication hole may be omitted, and a jet pump may be provided for pumping fuel into the sub-tank 20.

Next, an arrangement of the pressure-control valve 40 and the pressure-retention valve 60 will be described.

Figure 3:
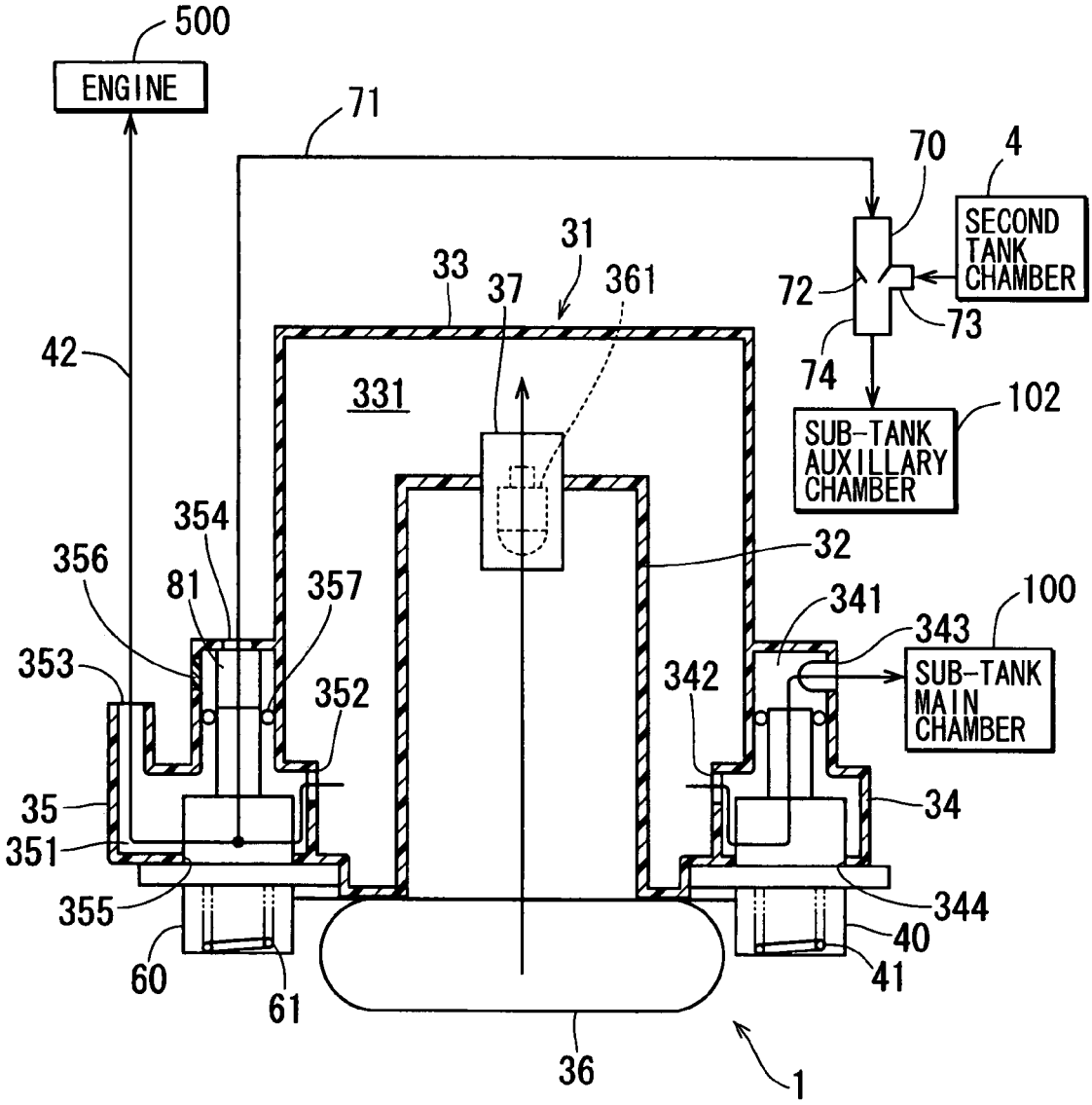
FIG. 3 is a schematic view showing a fuel passage of the fuel feed apparatus.
Figure 4:
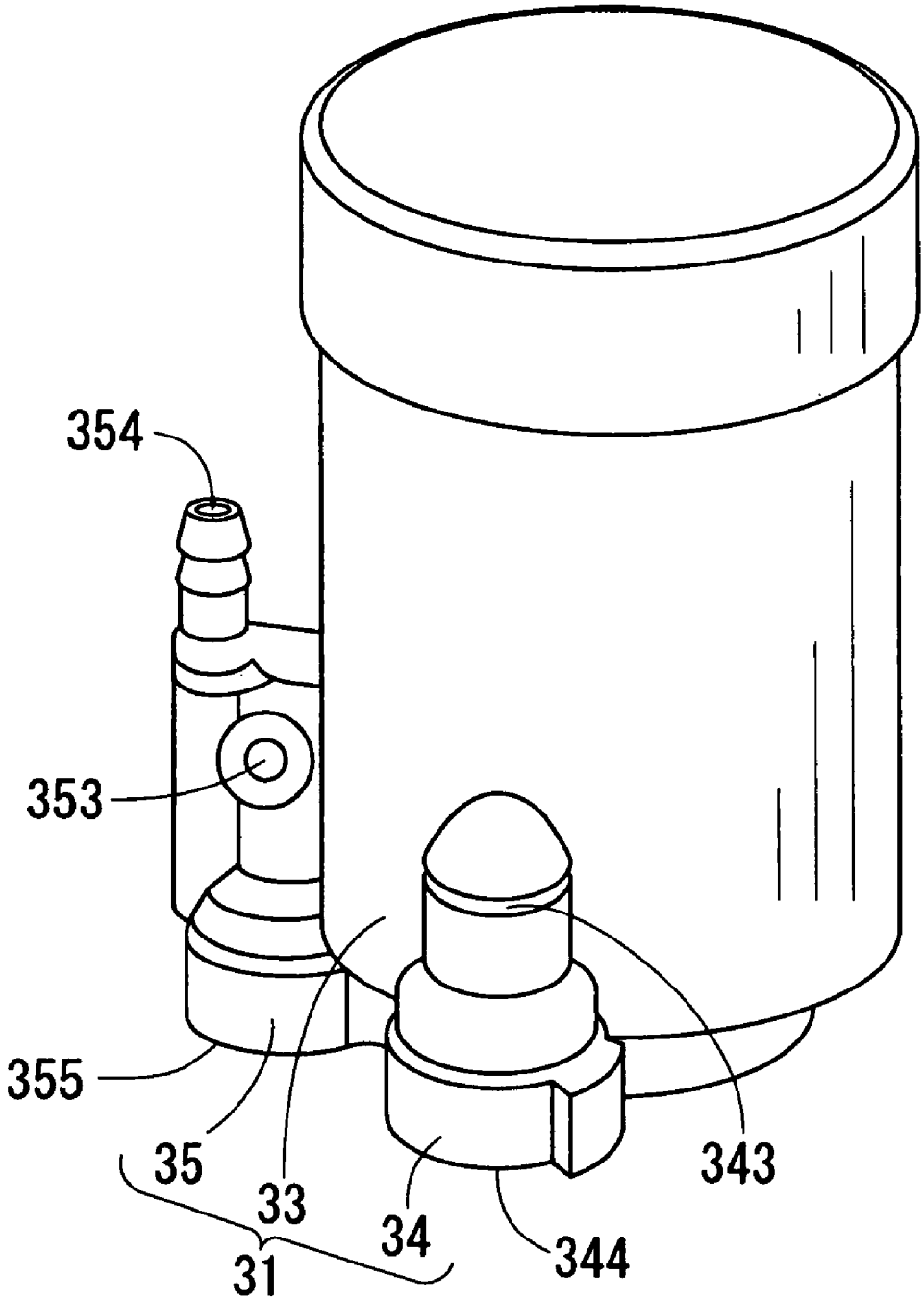
FIG. 4 is a perspective view showing a filter case of the fuel feed apparatus.

As shown in FIG. 3, the fuel pump 32 is supported in a filter case 31 that serves as a pump bracket. In FIG. 3, the fuel pump 32 is unillustrated. As shown in FIG. 4, the filter case 31 includes a main portion 33, a pressure-control housing portion 34, and a pressure-retention housing portion 35. The main portion 33 defines a fuel passage 331 therein. The pressure-control housing portion 34 defines therein a first space 341 that communicates with the fuel passage 331. The pressure-retention housing portion 35 defines therein a second space 351 that communicates with the fuel passage 331. The main portion 33, the pressure-control housing portion 34, and the pressure-retention housing portion 35 are integrally formed of resin.

The main portion 33 is in a substantially cylindrical shape vertically extending in FIG. 1. The main portion 33 accommodates the fuel pump 32 and the fuel filter 332. Fuel discharged from the fuel pump 32 flows from a discharge port 37 into the fuel passage 331 through the check valve 361. The fuel filter 332 is provided in the fuel passage 331. The fuel filter 332 circumferentially surrounds the outer periphery of the fuel pump 32. Fuel passing through the fuel filter 332 flows into either the pressure-control valve 40 or the pressure-retention valve 60 respectively through inflow ports 342, 352.

The pressure-control housing portion 34 is located on the lower side of the main portion 33. The pressure-control valve 40 is accommodated in the first space 341. The fuel passage 331 communicates with the first space 341 through the inflow port 342. The pressure-control valve 40 includes a valve member and a valve seat, which are unillustrated. A valve spring 41 biases the valve member onto the valve seat. When pressure of fuel flowing through the inflow port 342 becomes greater than predetermined first pressure P1, the valve member is lifted from the valve seat against resilience of the valve spring 41. Fuel entering through the inflow port 342 flows into the main chamber 100 (FIG. 2) of the sub-tank 20 through an outflow port 343. Thus, pressure of fuel in the fuel passage 331 is controlled not to become greater than the first pressure P1.

The pressure-control housing portion 34 has the lower side defining an opening 344. The pressure-control valve 40 is assembled to the pressure-control housing portion 34 by being inserted into the first space 341 through the opening 344. The pressure-control valve 40 is detachable from the pressure-control housing portion 34 through the opening 344. The pressure-control valve 40 and the opening 344 interpose an unillustrated sealing member therebetween.

The pressure-retention housing portion 35 is located on the lower side of the main portion 33. The pressure-retention valve 60 is accommodated in the second space 351. The fuel passage 331 communicates with the second space 351 through the inflow port 352. The pressure-retention housing portion 35 defines outflow ports 353, 354. When the fuel pump 32 operates, fuel entering through the inflow port 352 flows out of the pressure-retention housing portion 35 through the outflow ports 353, 354.

The outflow port 353 is connected with the bellows pipe 42. Fuel in the fuel passage 331 is controlled in pressure by the pressure-control valve 40, so that the pressure-controlled fuel is discharged to the engine 500 through the bellows pipe 42. The outflow port 354 is connected with a tube 71. The tube 71 serves as a jet-pump pipe. Fuel in the fuel passage 331 is controlled in pressure by the pressure-control valve 40, so that the pressure-controlled fuel is discharged to the jet pump 70 through the tube 71.

The pressure-retention valve 60 has a structure substantially equivalent to the structure of the pressure-control valve 40. The pressure-retention valve 60 includes a valve member and a valve seat, which are unillustrated. A valve spring 61 biases the valve member onto the valve seat. When the fuel pump 32 is operated, and pressure of fuel flowing into the pressure-retention valve 60 through the inflow port 352 becomes greater than the predetermined second pressure P2, the valve member is lifted from the valve seat against resilience of the valve spring 61. Thus, fuel in the pressure-retention valve 60 flows into the jet pump 70 through the outflow port 354 and the tube 71. In this structure, when the fuel pump 32 operates, the jet pump 70 discharges fuel, as long as the pressure of fuel is equal to or greater than the second pressure P2.

When pressure of fuel in the pressure-retention valve 60 is still greater than the predetermined second pressure P2 immediately after stopping the fuel pump 32, the valve member is lifted from the valve seat against resilience of the valve spring 61, so that fuel flows into the jet pump 70 through the outflow port 354 and the tube 71. The fuel flows into the jet pump 70 through the tube 71, so that pressure of fuel in the pressure-retention valve 60 decreases and becomes less than the predetermined second pressure P2. In this condition, the valve member is biased onto the valve seat by being applied with resilience of the valve spring 61, thereby stopping fuel flow through the outflow port 354 of the pressure-retention housing portion 35. Thus, pressure of fuel in the bellows pipe 42 is controlled substantially at the second pressure P2.

When the pressure-retention valve 60 stops fuel flow through the outflow port 354, the check valve 361 and the pressure-control valve 40 restricts fuel flow from the pressure-retention valve 60 through the outflow port 353. The second pressure P2 of the pressure-retention valve 60 is set to be less than the first pressure P1 of the pressure-control valve 40. Therefore, the pressure-retention valve 60 is capable of steadily flowing fuel into the jet pump 70 while the pressure-control valve 40 exhausts relief fuel. Thus, the jet pump 70 can be restricted from causing malfunction.

Specifically, when the second pressure P2 is set to be greater than the first pressure P1, and the pressure in the fuel passage 331 becomes between the second pressure P2 and the first pressure P1 during the fuel pump 32 operates, the pressure-retention valve 60 may block fuel flow of the jet pump 70, even the pressure-control valve 40 exhausts relief fuel. As a result, the jet pump 70 cannot be properly operated. By contrast, in this embodiment, the second pressure P2 of the pressure-retention valve 60 is set to be less than the first pressure P1 of the pressure-control valve 40. Therefore, the pressure-retention valve 60 is capable of steadily flowing fuel into the jet pump 70 while the pressure-control valve 40 exhausts relief fuel. Thus, the jet pump 70 can be restricted from causing malfunction.

Each of the inflow port 342 of the pressure-control housing portion 34 and the inflow port 352 of the pressure-retention housing portion 35 serves as a throttle portion of fuel flow. Each of the inflow ports 342, 352 restricts an amount of fuel flowing from the fuel passage 331 into corresponding one of the pressure-control valve 40 and the pressure-retention valve 60. In this structure, the inflow ports 342, 352 restricts fuel, which is large in pressure fluctuation after being discharged from the fuel pump 32, from flowing directly into the pressure-control valve 40 and the pressure-retention valve 60. Thus, pressure of fuel flowing through the pressure-control valve 40 and the pressure-retention valve 60 can be stabilized.

Fuel is discharged from the fuel pump 32, and pressure of the fuel is increased to the first pressure P1. The pressure of the fuel is decreased to the second pressure P2 set for the pressure-retention valve 60 in retention of the residual pressure after stopping the fuel pump 32. Reduction between the second pressure P2 and the first pressure P1 can be decreased by setting the second pressure P2 to be in the vicinity of the first pressure P1, so that energy consumption of the fuel pump 32 can be reduced. However, when the second pressure P2 is in the vicinity of the first pressure P1, the characteristic frequency of the valve spring 41 of the pressure-control valve 40 becomes near the characteristic frequency of the valve spring 61 of the pressure-retention valve 60. In this case, the valve springs 41, 61 may apt to resonate.

In view of this problem, in this first embodiment, the pressure-control housing portion 34 and the pressure-retention housing portion 35 are provided separately from each other. Thus, the valve springs 41, 61 can be restricted from resonating, compared with a structure in which the pressure-control housing portion 34 and the pressure-retention housing portion 35 are provided adjacent to each other. Therefore, reduction of energy consumption of the fuel pump 32 can be achieved by setting the second pressure P2 to be in the vicinity of the first pressure P1, in addition to achieving reduction of resonance of the valve springs 41, 61.

As referred to FIGS. 1, 2, a bracket 38 is provided to the top portion of the filter case 31. The bracket 38 has ends provided with hooking portions 381. The hooking portions 381 are hooked to the sub-tank 20, so that the filter case 31 is aligned, i.e., positioned relative to the sub-tank 20.

As referred to FIG. 2, the filter case 31 has a center axis 31*a* that is eccentric with respect to the center axis 20*a* of the sub-tank 20. The fuel pump 32 has a center axis 32*a* that is also eccentric with respect to the center axis 20*a* of the sub-tank 20.

More specifically, the filter case 31 is accommodated in the main chamber 100 such that the filter case 31 is located in the vicinity of one peripheral side of the sub-tank 20. The fuel pump 32 is accommodated in the main chamber 100 such that the fuel pump 32 is located in the vicinity of the one peripheral side of the sub-tank 20. The sub-tank 20 has a large space 21 on the opposite side of both the center axis 31*a* of the filter case 31 and center axis 32*a* of the fuel pump 32 with respect to the center axis 20*a* of the sub-tank 20.

The large space 21 accommodates the pressure-control valve 40, the pressure-retention valve 60, the jet pump 70, the tube 71, and the bellows pipe 42. In this structure, the inner space of the sub-tank 20, which is in the substantially cylindrical shape, can be effectively utilized. The hooking portions 381 are located on the opposite side of the large space 21 in the sub-tank 20.

As follows, an operation of the fuel feed apparatus 1 is described. The fuel pump 32 operates to pressurize fuel, and the pressurized fuel is controlled in pressure by the pressure-control valve 40. The pressure-controlled fuel is supplied to the engine 500 after passing through the pressure-retention valve 60 and the bellows pipe 42. The pressure-controlled fuel is also supplied to the jet pump 70 through the tube 71. The jet pump 70 jets the pressure-controlled fuel, thereby generating suction pressure to draw fuel from the second tank chamber 4 of the fuel tank 2, so that the jet pump 70 transfers the fuel from the second tank chamber 4 of the fuel tank 2 into the sub-tank 20.

When the fuel pump 32 operates, pressure of the fuel supplied to the engine 500 and the jet pump 70 is less than the first pressure P1 set for the pressure-control valve 40. That is, fuel is regularly supplied to the jet pump 70 as long as pressure of fuel flowing into the pressure-retention valve 60 is equal to or greater than the second pressure P2, which is less than the first pressure P1. Here, pressure of fuel flowing into the pressure-retention valve 60 becomes less than the second pressure P2 in a condition where, for example, the amount of fuel discharged from the fuel pump 32 is less than the amount of fuel requested from the engine 500.

The fuel pump 32 stops when, for example, the engine 500 stops or an engine brake is applied. When the fuel pump 32 stops and pressure in the pressure-retention valve 60 is greater than the second pressure P2, fuel in the bellows pipe 42 flows into the jet pump 70 through the outflow port 354. Pressure of fuel in the bellows pipe 42 decreases, so that pressure of fuel in the pressure-retention valve 60 becomes equal to or less than the second pressure P2. In this condition, the pressure-retention valve 60 prohibits fuel from flowing to the jet pump 70, so that pressure of fuel in the pressure-retention valve 60 is maintained at the second pressure P2.

When the fuel pump 32 stops, and pressure of fuel in the tube 71 becomes substantially 0 kPa, pressure in the bellows pipe 42 is maintained substantially at the second pressure P2. Thus, in a condition where the fuel pump 32 stops and the engine 500 requests fuel supply, the fuel feed apparatus 1 is capable of quickly supplying fuel in the second pressure P2 to the engine 500, so that the injector is capable of spraying fuel at the predetermined pressure.

In the structure of the first embodiment, the pressure-control valve 40 and the pressure-retention valve 60 are provided to the filter case 31 that holds the fuel pump 32. Therefore, constraints of installation for the fuel feed apparatus 1 can be reduced, compared with a structure in which at least one of the pressure-control valve 40 and the pressure-retention valve 60 is provided to a pipe through which fuel is supplied from the pump module 30 to the engine 500.

A location of the pressure-control valve 40 may differ in dependence upon the type of vehicle. In a type of a vehicle, a fuel feed apparatus may have a filter case 31 provided with a pressure-control valve 40. In another type of a vehicle, a fuel feed apparatus may have a fuel pipe, which extends from a filter case 31 to an engine 500, provided with a pressure-control valve 40. A fuel source, which supplies fuel to the jet pump 70, differs in dependence upon the type of vehicle.

In the above fuel feed apparatus 1, the fuel pump 32 discharges fuel, and the nozzle 72 of the jet pump 70 partially jets the discharged fuel. Alternatively, a fuel pump may have a structure, in which a nozzle jets relief fuel exhausted from the pressure-control valve 40 and/or surplus fuel returning from the engine 500. In this alternative structure, the engine 500 returning the return fuel and/or the pressure-control valve 40 exhausting relief fuel serves as a fuel source for the jet pump 70, accordingly, the pressure-retention valve 60 need not be provided in this structure.

In the above structure of the first embodiment, the filter case 31 having the same shape can be commonly applied to various types of vehicles, regardless of the location of the pressure-control valve 40 and existence or nonexistence of the pressure-retention valve 60. Specifically, the pressure-control housing portion 34, which accommodates the pressure-control valve 40, and the pressure-retention housing portion 35, which accommodates the pressure-retention valve 60, are integrally formed of resin together with the filter case 31.

Figure 5:
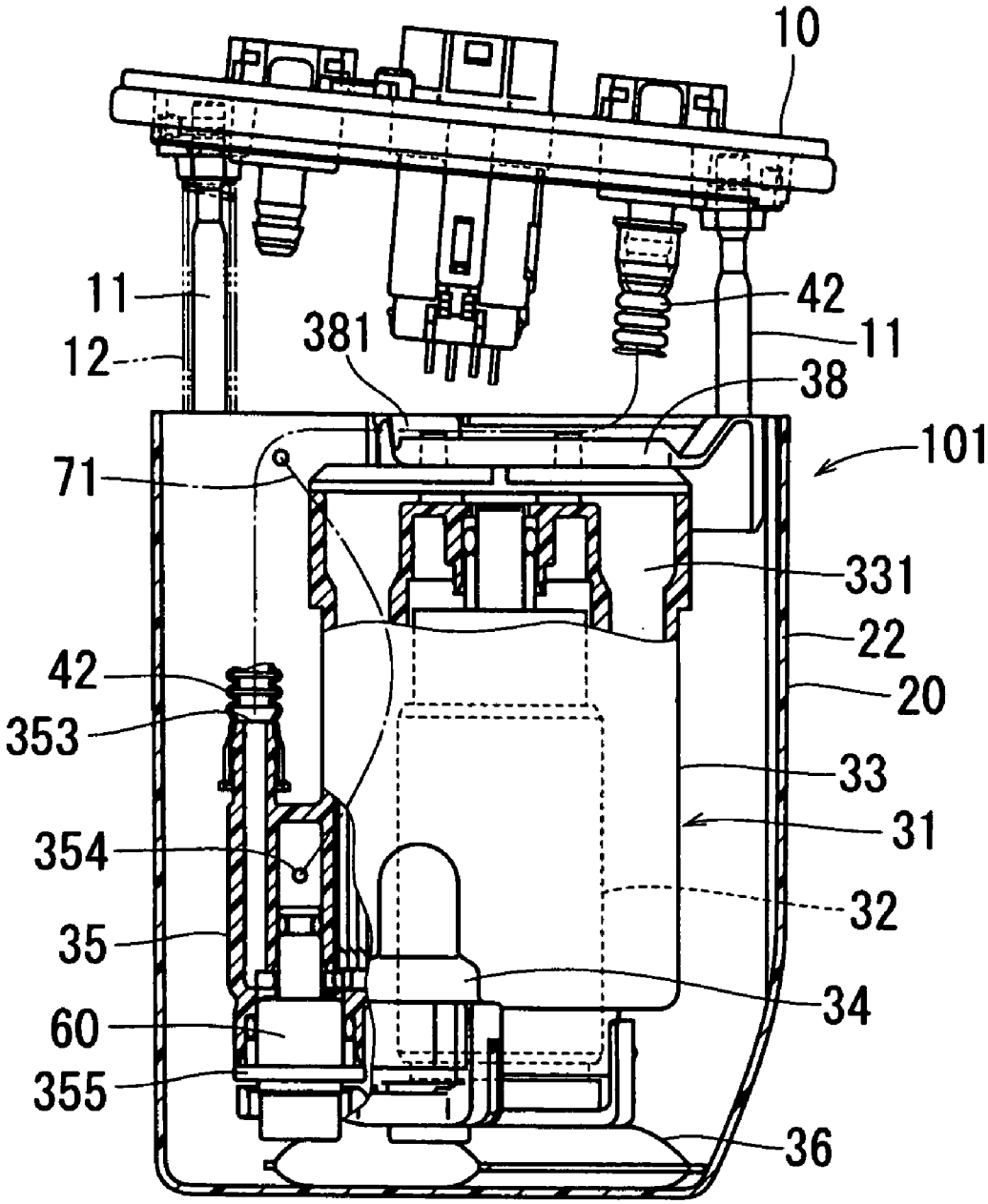
FIG. 5 is a sectional longitudinal view showing a fuel feed apparatus including a filter case, which is distant from a pressure-control valve.

Here, a fuel feed apparatus 101 shown in FIG. 5 has a structure, in which the pressure-control valve 40 is distant from the filter case 31.

The filter case 31 of the fuel feed apparatus 1 shown in FIG. 1 can be applied to the fuel feed apparatus 101 in FIG. 5 by removing the pressure-control valve 40 from the pressure-control housing portion 34 of the fuel feed apparatus 1. Thus, the filter case 31 can be commonly applied to the fuel feed apparatus 101 (FIG. 5), in which the pressure-control valve 40 is distant from the filter case 31. In the above structure, commonality of the filter case 31 having the same shape can be achieved between the fuel feed apparatuses 1, 101 respectively in FIGS. 1, 5.

The fuel filter 332 in the fuel passage 331 may be removed from the filter case 31 of the fuel feed apparatus 1 in FIG. 1, so that the filter case 31 can be applied to the fuel feed apparatus 101 in FIG. 5. The fuel feed apparatus 101 in FIG. 5 does not include the fuel filter 332. Thus, commonality of the filter case 31 having the same shape can be also achieved between the fuel feed apparatuses 1, 101 respectively in FIGS. 1, 5.

Figure 6:
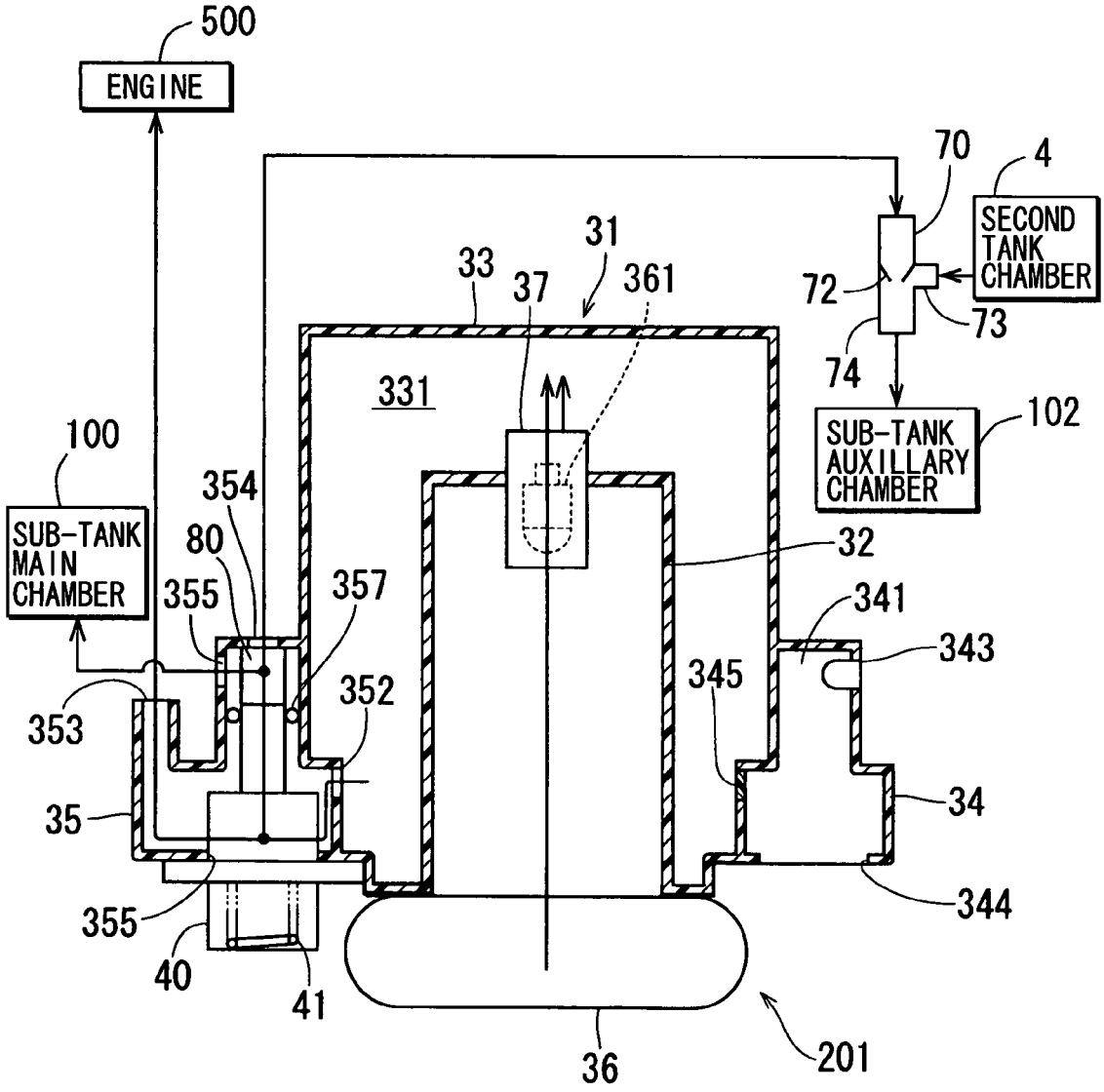
FIG. 6 is a schematic view showing a fuel passage of a fuel feed apparatus, which does not include a residual-pressure-retention valve.

A fuel feed apparatus may be provided with a jet pump that is different from the above jet pump, which jets fuel discharged from the fuel pump 32 partially through the nozzle 72. In this structure, the pressure-retention valve 60 may be omitted, and the pressure-control valve 40 may be provided instead of the pressure-retention valve 60. Specifically, the pressure-retention valve 60 is removed from the pressure-retention housing portion 35 of the filter case 31 of the fuel feed apparatus 1 in FIG. 1, and the pressure-control valve 40 is provided to the pressure-retention housing portion 35, so that a fuel feed apparatus 201 shown in FIG. 6 is constructed. Thus, the filter case 31 of the fuel feed apparatus 1 in FIG. 1 can be applied to the fuel feed apparatus 201 in FIG. 6 Thus, commonality of the filter case 31 having the same shape can be also achieved between the fuel feed apparatuses 1, 201 respectively in FIGS. 1, 6.

As referred to FIG. 6, when the pressure-control valve 40 is removed from the pressure-control housing portion 34, the inflow port 342 (FIG. 3) of the filter case 31 may be plugged with a cap 345 (FIG. 6) or the like. As referred to FIG. 6, the pressure-retention valve 60 is omitted from the fuel feed apparatus 201. In this fuel feed apparatus 201, a relief valve 80 is preferably provided for prohibiting high pressure fuel from flowing through the jet pump 70 so as to protect the nozzle 72.

In the fuel feed apparatus 201 shown in FIG. 6, the relief valve 80 is provided in the upstream of the pressure-control valve 40 within the pressure-retention housing portion 35, which serves as a pressure-control housing portion. Relief fuel exhausted from the relief valve 80 flows into the main chamber 100 of the sub-tank 20 through an opening 355 of the pressure-retention housing portion 35.

As referred to FIG. 1, in the fuel feed apparatus 1 of this first embodiment, the pressure-control housing portion 34 has a space, which is capable of receiving the relief valve 80. This space, which is capable of receiving the relief valve 80, is provided with a dummy member 81 (FIG. 3). In this structure, the pressure-control housing portion 34 can be commonly used, regardless of providing the relief valve 80 to the pressure-control housing portion 34. As referred to FIG. 6, the opening 355 is plugged with a cap 356. Thus, commonality of the filter case 31 having the same shape can be also achieved between the fuel feed apparatuses 1, 201 respectively in FIGS. 1, 6. The pressure-retention valve 60 and the pressure-retention housing portion 35 interpose an O-ring 357 therebetween. This O-ring 357 partitions the second space 351 in the pressure-retention housing portion 35 into a space, which accommodates the dummy member 81, and a space, which accommodates the pressure-retention valve 60.

In this embodiment, the pressure-control housing portion 34 and the pressure-retention housing portion 35 are integrally formed of resin together with the filter case 31. Therefore, the number of components of the fuel feed apparatus 1 can be reduced.

Second Embodiment

Figure 7:
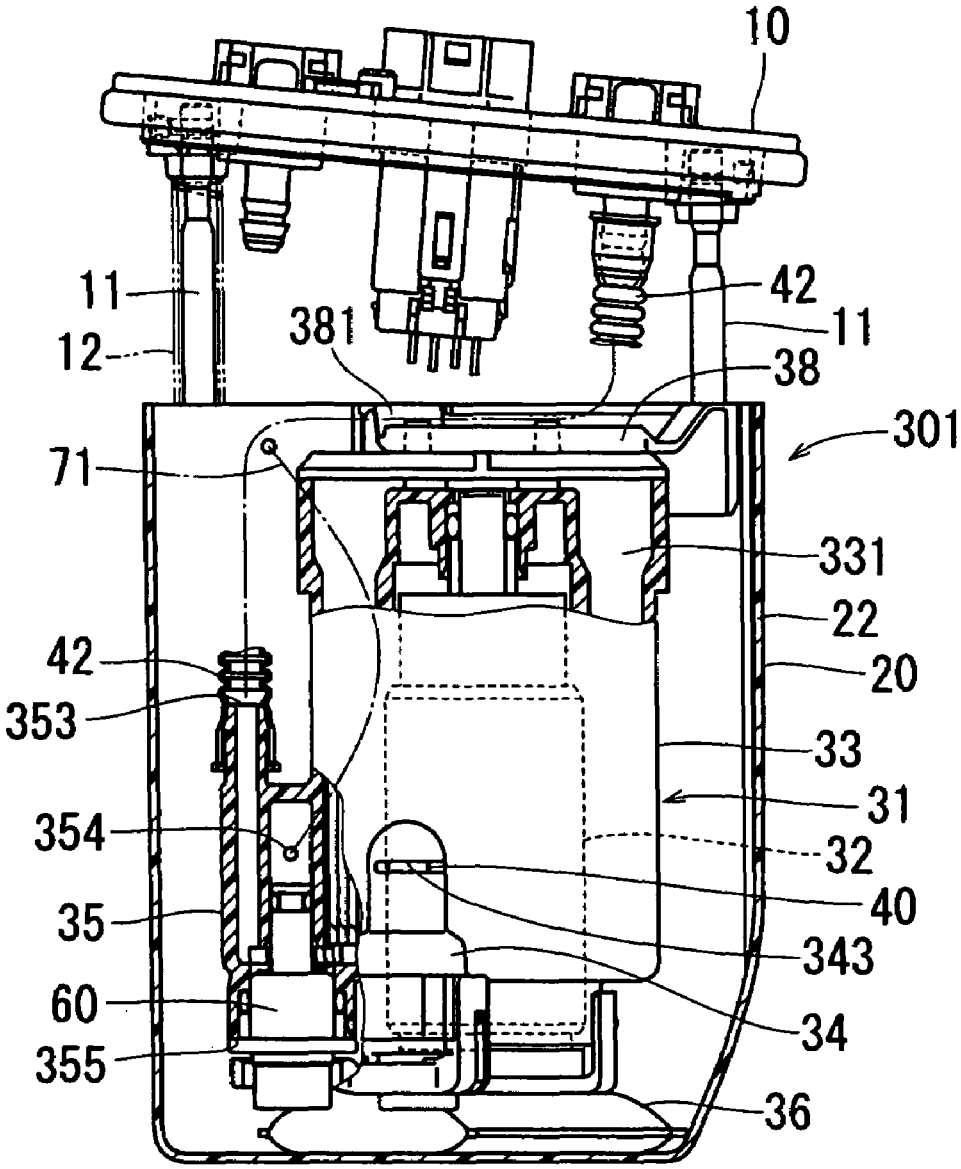
FIG. 7 is a sectional longitudinal view showing a fuel feed apparatus according to a second embodiment.

As shown in FIG. 7, in a fuel feed apparatus 301 of this second embodiment, the fuel filter 332, which is described in the first embodiment, is omitted. The fuel passage 331 defined in the filter case 31 is in the shape equivalent to the shape of the fuel passage 331 in the first embodiment.

The fuel filter 332 can be provided to the fuel passage 331 of the filter case 31 in the fuel feed apparatus 301 in FIG. 7, so that the filter case 31 of the fuel feed apparatus 301 in FIG. 7 can be applied to the fuel feed apparatus 1, which includes the fuel filter 332, in FIG. 1. Thus, commonality of the filter case 31 having the same shape can be also achieved between the fuel feed apparatuses 301, 1 respectively in FIGS. 7, 1.

In this second embodiment, the pressure-control housing portion 34 and the pressure-retention housing portion 35 are also integrally formed of resin together with the filter case 31. Therefore, the filter case 31 of the fuel feed apparatus 301 in FIG. 7 can be also applied to the fuel feed apparatus 101 in FIG. 5, so that an effect equivalent to the effect of the first embodiment can be produced.

Third Embodiment

Figure 8:
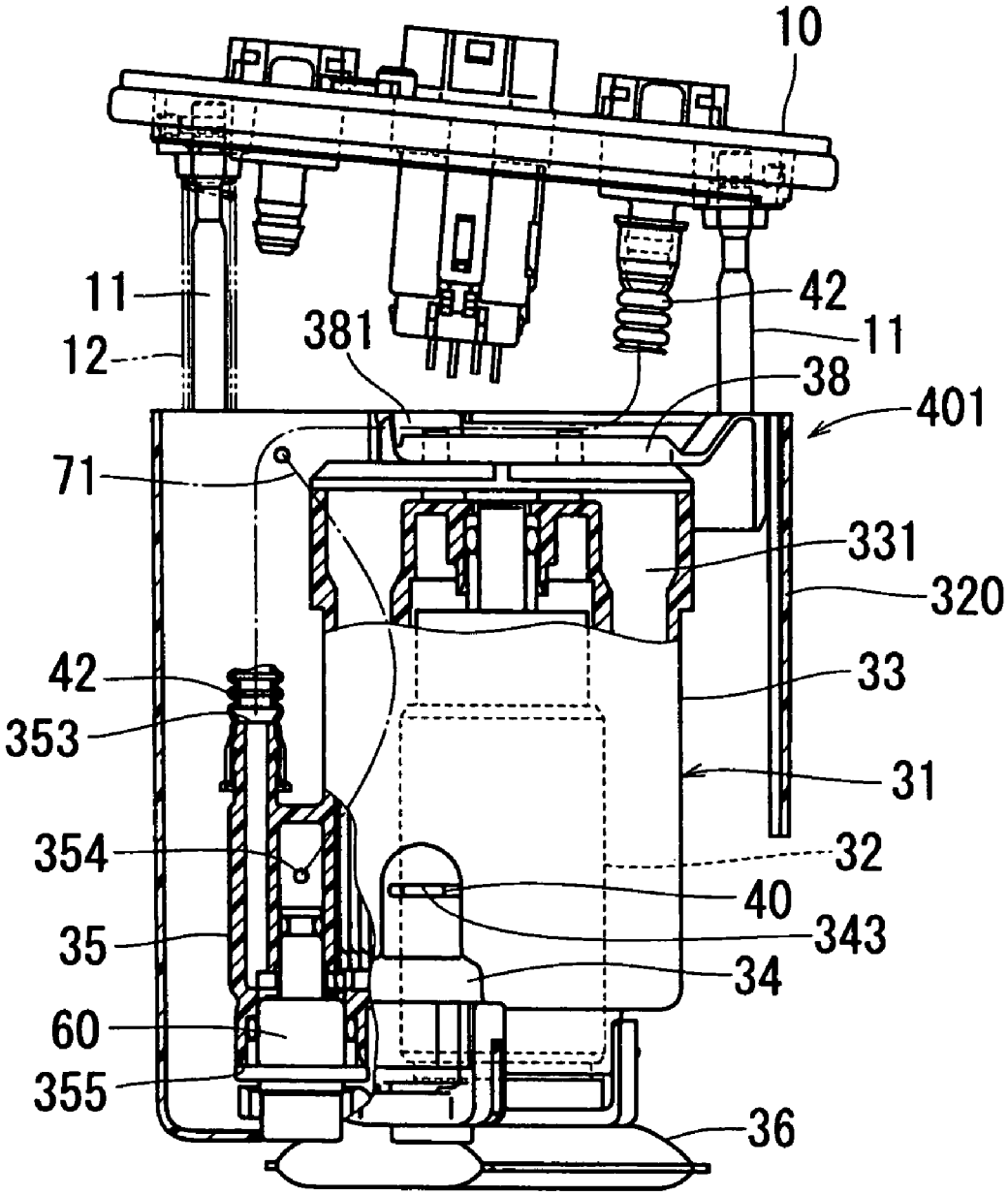
FIG. 8 is a sectional longitudinal view showing a fuel feed apparatus according to a third embodiment.

As shown in FIG. 8, in a fuel feed apparatus 401 of this third embodiment, the sub-tank 20 and the fuel filter 332, described in the first embodiment, are omitted. The fuel passage 331 is in a shape equivalent to the shape the fuel passage 331 in the first embodiment.

In this third embodiment, a bracket 320 is provided to the fuel feed apparatus 401, instead of the sub-tank 20. The bracket 320 has an inserted portion, which is equivalent to the inserted portion 23 of the sub-tank 20 in the first embodiment. The flange 10 is movable vertically relative to the filter case 31 via the bracket 320 in the fuel tank 2. Even when the fuel tank 2 expands or shrinks, the bottom of the suction filter 36 can be regularly pressed onto the inner bottom periphery of the fuel tank 2. Thus, even in this structure, the fuel feed apparatus 401 is capable of drawing a small amount of fuel remaining in the bottom of the fuel tank 2 through the suction filter 36.

In the above structure of the third embodiment, the sub-tank 20 in the fuel feed apparatus 1 in FIG. 1 is replaced to the bracket 320 of the fuel feed apparatus 401 in FIG. 8, so that the filter case 31 of the fuel feed apparatus 401 in FIG. 8 can be applied to the filter case 31 of the fuel feed apparatus 1 in FIG. 1. Thus, commonality of the filter case 31 having the same shape can be also achieved between the fuel feed apparatuses 401, 1 respectively in FIGS. 8, 1.

In this third embodiment, the pressure-control housing portion 34 and the pressure-retention housing portion 35 are also integrally formed of resin together with the filter case 31. Therefore, the filter case 31 of the fuel feed apparatus 401 in FIG. 8 can be also applied to the fuel feed apparatus 101 in FIG. 5, so that an effect equivalent to the effect of the first embodiment can be produced.

In the above structures, the filter case 31 can be applied to another fuel feed apparatus, in which the pressure-control valve 40 is distant from the filter case 31, by removing the pressure-control valve 40 from the pressure-control housing portion 34 of the filter case 31. Alternatively, the filter case 31 can be applied to another fuel feed apparatus, which does not include the pressure-retention valve 60, by removing the pressure-retention valve 60 from the pressure-retention housing portion 35 of the filter case 31. Thus, commonality of the filter case 31 having the same shape can be also achieved among the fuel feed apparatuses by removing at least one of the valves 40, 60, and additionally providing a component to the remaining space of the at least one of the valves 40, 60.

Other Embodiment

In the first embodiment, the pressure-control housing portion 34 and the pressure-retention housing portion 35 are provided to the filter case 31. Alternatively, for example, the pressure-control housing portion 34 and the pressure-retention housing portion 35 may be provided to a support member, which does not include the fuel filter 332, provided for positioning the pump module 30 with respect to the sub-tank 20.

In the above first embodiment, the pressure-control valve 40, the pressure-retention valve 60, the jet pump 70, the tube 71, and the bellows pipe 42 are arranged in the large space 21 of the sub-tank 20. Alternatively, for example, at least one of the pressure-control valve 40, the pressure-retention valve 60, the jet pump 70, the tube 71, and the bellows pipe 42 may be arranged in the large space 21. Even in this structure, the large space 21 can be effectively utilized.

In the first embodiment, both the pressure-control valve 40 and the pressure-retention valve 60 are provided to the filter case 31. Alternatively, one of the pressure-control valve 40 and the pressure-retention valve 60 may be removed from the filter case 31. In either structures, the inner space of the sub-tank can be effectively used. Both of the pressure-control valve 40 and the pressure-retention valve 60 may be removed from the filter case 31.

In the first embodiment, the sub-tank 20 other than the step portion 28 defines therein the inner space in a substantially circular shape. Alternatively, for example, the step portion 28 may be omitted from the sub-tank 20, so that the inner space of the sub-tank 20 may be in a substantially circular shape. The inner space of the sub-tank 20 may be in any one of a substantially semicircular shape and a substantially rectangular shape. The inner space of the sub-tank 20 may be in an arc shape circumferentially extending around the fuel pump 32.

The above structures of the embodiments can be combined as appropriate.

Various modifications and alternations may be diversely made to the above embodiments without departing from the spirit of the present invention.

What is claimed is:

1. A fuel feed apparatus for an internal combustion engine having a fuel tank, the fuel feed apparatus comprising:

a fuel pump for pumping fuel from the fuel tank to the internal combustion engine;

a pressure-control valve for controlling pressure of fuel, which is discharged from the fuel pump, to be equal to or less than a first pressure;

a jet pump for generating suction pressure by jetting fuel, which is discharged from the fuel pump, partially through a nozzle;

a pressure-retention valve that is provided in an upstream of the jet pump with respect to fuel flow from the fuel pump for maintaining pressure of fuel in the upstream at a second pressure, which is less than the first pressure; and a pump bracket for holding the fuel pump, wherein the pressure-control valve and the pressure-retention valve are connected to the pump bracket.

2. The fuel feed apparatus according to claim 1, wherein the pump bracket defines a fuel passage through which the pressure-control valve communicates with the pressure-retention valve.

3. The fuel feed apparatus according to claim 1, further comprising:

a sub-tank that is accommodated in the fuel tank to receive the fuel pump and the pump bracket, wherein the fuel pump has a center axis that is eccentric with respect to a center axis of the sub-tank, the pump bracket has a center axis that is eccentric with respect to the center axis of the sub-tank, the sub-tank has a large space therein on an opposite side of the center axis of both the fuel pump and the center axis of the pump bracket with respect to the center axis of the sub-tank, and the large space accommodates the pressure-control valve and the pressure-retention valve.

4. The fuel feed apparatus according to claim 3, wherein the large space accommodates the jet pump.

5. The fuel feed apparatus according to claim 3, further comprising:

a jet-pump pipe that connects the pressure-retention valve with the jet pump; and an engine pipe that connects the pressure-retention valve with the internal combustion engine, wherein the large space accommodates at least one of the jet-pump pipe and the engine pipe.

6. The fuel feed apparatus according to claim 2, wherein the pump bracket has a pressure-control valve holder and a pressure-retention valve holder, the pressure-control valve holder defines a first space that accommodates the pressure-control valve and communicates with the fuel passage, and the pressure-retention valve holder defines a second space that accommodates the pressure-retention valve and communicates with the fuel passage.

7. A fuel feed apparatus for an internal combustion engine having a fuel tank, the fuel feed apparatus comprising:

a fuel pump for pumping fuel from the fuel tank to the internal combustion engine; and a pump bracket for holding the fuel pump, the pump bracket defining a fuel passage through which the fuel pump discharges fuel, wherein the pump bracket has a pressure-control valve holder and a pressure-retention valve holder, the pressure-control valve holder is connectable with a pressure-control valve, which is for controlling pressure of fuel, discharged from the fuel pump, to be equal to or less than a first pressure, the pressure-control valve holder defines a first space communicating with the fuel passage, the pressure-retention valve holder is connectable with a pressure-retention valve, which is for maintaining pressure of fuel at a second pressure less than the first pressure, and the pressure-retention valve holder defines a second space communicating with the fuel passage.

8. The fuel feed apparatus according to claim 7, wherein the pressure-control valve holder defines the first space for accommodating the pressure-control valve, the first space communicates with the fuel passage, the pressure-retention valve holder defines the second space for accommodating the pressure-retention valve, and the second space communicates with the fuel passage.

9. The fuel feed apparatus according to claim 7, wherein the pressure-control valve holder is separate from the pressure-retention valve holder.

10. The fuel feed apparatus according to claim 7, wherein the pump bracket includes a main portion, which defines the fuel passage, and the main portion, the pressure-control valve holder, and the pressure-retention valve holder are integrally formed or resin.

11. The fuel feed apparatus according to claim 7, wherein the pressure-control valve holder is connectable with any one of the pressure-control valve and the pressure-retention valve, and the pressure-retention valve holder is connectable with an other one of the pressure-control valve and the pressure-retention valve.

* * * * *